US006188051B1

(12) United States Patent
Kusek

(10) Patent No.: US 6,188,051 B1
(45) Date of Patent: Feb. 13, 2001

(54) METHOD OF MANUFACTURING A SHEATHED ELECTRICAL HEATER ASSEMBLY

(75) Inventor: Walter W. Kusek, Cornelius, NC (US)

(73) Assignee: Watlow Polymer Technologies, Winona, MN (US)

( * ) Notice: Under 35 U.S.C. 154(b), the term of this patent shall be extended for 0 days.

(21) Appl. No.: 09/323,508

(22) Filed: Jun. 1, 1999

(51) Int. Cl.[7] ..... H05B 3/44
(52) U.S. Cl. ..... 219/544; 392/503; 338/265
(58) Field of Search ..... 219/534, 544, 219/553; 392/497, 502, 503; 338/254, 255, 262, 263, 264, 265, 269, 275

(56) References Cited

U.S. PATENT DOCUMENTS

| | | | |
|---|---|---|---|
| D. 224,406 | 7/1972 | Heck | D26/1 |
| 1,043,922 | 11/1912 | Gold | 219/523 |
| 1,046,465 | 12/1912 | Hoyt . | |
| 1,281,157 | 10/1918 | Hadaway, Jr. . | |
| 1,477,602 | 12/1923 | Simon . | |

(List continued on next page.)

FOREIGN PATENT DOCUMENTS

| | | |
|---|---|---|
| 35 12 659 | 9/1986 | (DE) . |
| 3512659 | 10/1986 | (DE) . |
| 38 36 387 C1 | 5/1990 | (DE) . |
| 14562 | 9/1913 | (GB) . |
| 1070849 | 6/1967 | (GB) . |

(List continued on next page.)

OTHER PUBLICATIONS

"Polymers", *Guide to Selecting Engineered Materials*, a special issue of *Advanced Materials * Processes*, Metals Park, OH, ASM International, 1989, pp.92–93.

"Makroblend Polycarbonate Blend, Tedur Polyphenylene Sulfide", *Machinbe Design: Basics of Design Engineering*, Cleveland, OH, Penton Publishing, Inc., Jun. 1991, pp. 820–821, 863, 866–867.

(List continued on next page.)

*Primary Examiner*—Teresa Walberg
*Assistant Examiner*—Fadi H. Dahbour
(74) *Attorney, Agent, or Firm*—Duane, Morris & Heckscher LLP

(57) ABSTRACT

A method of manufacturing a sheathed electrical heater assembly comprising the steps of: molding a core element into a desired shape, the core element having an outer surface; heating the core element at an elevated temperature sufficient to release organic material from the core element; placing a heating element in communication with the core element; and, encapsulating the core, and the heating element in an insulation protection layer, whereby the heater assembly is formed. Additionally shown is a sheathed electrical heater assembly comprising: a core made of an organo-ceramic material; a heating element in communication with the core; an insulation protection layer encapsulating the core and heating element to produce the heater assembly, the protection layer comprising and organo-ceramic material; and, a sheath encapsulating the heater assembly, the sheath also comprising an organo-ceramic material.

19 Claims, 1 Drawing Sheet

U.S. PATENT DOCUMENTS

| | | | |
|---|---|---|---|
| 1,674,488 | 6/1928 | Tang . | |
| 1,987,119 | 1/1935 | Long | 219/39 |
| 1,992,593 | 2/1935 | Whitney | 219/46 |
| 2,146,402 | 1/1939 | Morgan | 219/523 |
| 2,274,445 | 2/1942 | Greer | 219/38 |
| 2,426,976 | 9/1947 | Taulman | 219/19 |
| 2,456,343 | 12/1948 | Tuttle | 201/67 |
| 2,464,052 | 3/1949 | Numrich | 219/38 |
| 2,593,459 | 4/1952 | Johnson | 219/39 |
| 2,710,909 | 11/1953 | Logan et al. | 219/46 |
| 2,719,907 | 10/1955 | Combs | 219/46 |
| 2,889,439 | 6/1959 | Musgrave | 219/19 |
| 2,938,992 | 5/1960 | Crump | 219/46 |
| 3,173,419 | 3/1965 | Dubilier et al. | 128/399 |
| 3,201,738 | 8/1965 | Mitoff . | |
| 3,211,203 | 10/1965 | Creed et al. . | |
| 3,238,489 | 3/1966 | Hay . | |
| 3,268,846 | 8/1966 | Morey | 338/212 |
| 3,296,415 | 1/1967 | Eisler | 219/385 |
| 3,352,999 | 11/1967 | Macoicz et al. | 219/321 |
| 3,374,338 | 3/1968 | Morey | 219/529 |
| 3,496,517 | 9/1967 | Walter | 339/18 |
| 3,564,589 | 2/1971 | Arak | 219/331 |
| 3,573,430 | 4/1971 | Eisler | 219/385 |
| 3,597,591 | 8/1971 | Van Derlip | 219/528 |
| 3,614,386 | 10/1971 | Hepplewhite | 219/312 |
| 3,621,566 | 11/1971 | Welsh | 29/610 |
| 3,657,517 | 4/1972 | Hoyt | 219/535 |
| 3,683,361 | 8/1972 | Salzwedel | 338/322 |
| 3,686,472 | 8/1972 | Harris | 219/213 |
| 3,707,618 | 12/1972 | Zeitlin et al. | 219/336 |
| 3,831,129 | 8/1974 | Frey | 339/19 |
| 3,860,787 | 1/1975 | Strobach | 219/336 |
| 3,878,362 | 4/1975 | Stinger | 219/528 |
| 3,925,928 | 10/1976 | Watanabe et al. | 428/273 |
| 3,927,300 | 12/1975 | Wada et al. | 219/381 |
| 3,943,328 | 3/1976 | Cunningham | 219/335 |
| 3,952,182 | 4/1976 | Flanders | 219/309 |
| 3,968,348 | 7/1976 | Stanfield | 219/535 |
| 3,976,855 | 8/1976 | Altmann et al. | 219/532 |
| 3,987,275 | 10/1976 | Hurko | 219/461 |
| 4,021,642 | 5/1977 | Fields, Jr. | 219/391 |
| 4,046,989 | 9/1977 | Parise et al. | 219/437 |
| 4,058,702 | 11/1977 | Jerles | 219/321 |
| 4,083,355 | 4/1978 | Schwank | 126/39 J |
| 4,094,297 | 6/1978 | Ballentine | 126/39 J |
| 4,112,410 | 9/1978 | Wrob et al. . | |
| 4,117,311 | 9/1978 | Sturm | 219/544 |
| 4,152,578 | 5/1979 | Jacobs | 219/336 |
| 4,186,294 | 1/1980 | Bender | 219/527 |
| 4,201,184 | 5/1980 | Scheidler et al. | 126/39 J |
| 4,217,483 | 8/1980 | Vogel et al. | 219/541 |
| 4,224,505 | 9/1980 | Sturm | 219/544 |
| 4,272,673 | 6/1981 | Semanaz et al. | 219/544 |
| 4,294,643 | 10/1981 | Tadewald | 156/293 |
| 4,296,311 | 10/1981 | Hagglund et al. | 219/464 |
| 4,313,053 | 1/1982 | Sturm | 219/544 |
| 4,313,777 | 2/1982 | Buckley et al. | 156/272 |
| 4,326,121 | 4/1982 | Welsby et al. | 219/523 |
| 4,334,146 | 6/1982 | Sturm | 219/492 |
| 4,337,182 | 6/1982 | Needham | 524/609 |
| 4,346,287 | 8/1982 | Desloge . | |
| 4,349,219 | 9/1982 | Sturm | 285/21 |
| 4,354,096 | 10/1982 | Dumas | 219/523 |
| 4,358,552 | 11/1982 | Shinohara et al. | 523/443 |
| 4,375,591 | 3/1983 | Sturm | 219/544 |
| 4,419,567 | 12/1983 | Murphy et al. | 219/336 |
| 4,436,988 | 3/1984 | Blumenkranz | 219/544 |
| 4,493,985 | 1/1985 | Keller | 219/535 |
| 4,501,951 | 2/1985 | Benin et al. . | |
| 4,530,521 | 7/1985 | Nyffeler et al. | 285/21 |
| 4,540,479 * | 9/1985 | Sakurai et al. | 219/553 |
| 4,606,787 | 8/1986 | Pelligrino | 156/632 |
| 4,633,063 | 12/1986 | Willis . | |
| 4,641,012 | 2/1987 | Roberts | 219/331 |
| 4,687,905 | 8/1987 | Cunningham et al. | 219/336 |
| 4,703,150 | 10/1987 | Kunnecke et al. | 219/535 |
| 4,707,590 | 11/1987 | Lefebvre | 219/523 |
| 4,725,717 | 2/1988 | Harrison | 219/528 |
| 4,751,528 | 6/1988 | Spehrley, Jr. et al. | 346/140 |
| 4,756,781 | 7/1988 | Etheridge | 156/85 |
| 4,860,434 | 8/1989 | Louison et al. | 29/611 |
| 4,865,014 | 9/1989 | Nelson | 126/361 |
| 4,913,666 | 4/1990 | Murphy | 439/709 |
| 4,948,948 | 8/1990 | Lesage | 219/329 |
| 4,956,138 | 9/1990 | Barfield | 264/129 |
| 4,970,528 | 11/1990 | Beaufort et al. | 346/25 |
| 4,986,870 | 1/1991 | Frohlich | 156/382 |
| 4,993,401 | 2/1991 | Diekmann et al. | 126/39 |
| 5,013,890 | 5/1991 | Gamble | 392/497 |
| 5,021,805 | 6/1991 | Imaizumi et al. | 346/76 R |
| 5,038,458 | 8/1991 | Wagoner et al. | 29/593 |
| 5,041,846 | 8/1991 | Vincent et al. | 346/25 |
| 5,051,275 | 9/1991 | Wong | 427/58 |
| 5,066,852 | 11/1991 | Willbanks | 219/544 |
| 5,113,480 | 5/1992 | Murphy et al. | 392/501 |
| 5,129,033 | 7/1992 | Ferrara et al. | 392/447 |
| 5,136,143 * | 8/1992 | Kutner et al. | 219/544 |
| 5,155,800 | 10/1992 | Rezabek et al. | 382/503 |
| 5,237,155 * | 8/1993 | Hill | 219/544 |
| 5,252,157 | 10/1993 | Inhofe, Jr. | 156/158 |
| 5,255,942 | 10/1993 | Kenworthy | 285/21 |
| 5,287,123 | 2/1994 | Medin et al. | 346/140 R |
| 5,293,446 | 3/1994 | Owens et al. | 392/449 |
| 5,300,760 * | 4/1994 | Batliwalla et al. | 219/544 |
| 5,304,778 * | 4/1994 | Dasgupta et al. | 219/544 |
| 5,389,184 | 2/1995 | Jacaruso et al. | 156/378 |
| 5,397,873 | 3/1995 | Stoops et al. | 219/450 |
| 5,406,316 | 4/1995 | Schwiebert et al. | 347/18 |
| 5,406,321 | 4/1995 | Schwiebert et al. | 347/102 |
| 5,453,599 * | 9/1995 | Hall, Jr. | 219/544 |
| 5,461,408 | 10/1995 | Giles et al. | 347/102 |
| 5,476,562 | 12/1995 | Inhofe, Jr. | 156/156 |
| 5,477,033 | 12/1995 | Bergholtz | 219/549 |
| 5,500,667 | 3/1996 | Schwiebert et al. | 347/102 |
| 5,521,357 * | 5/1996 | Lock et al. | 219/544 |
| 5,572,290 | 11/1996 | Ueno et al. | 399/329 |
| 5,581,289 | 12/1996 | Firl et al. | 347/104 |
| 5,582,754 | 12/1996 | Smith et al. | 219/438 |
| 5,586,214 | 12/1996 | Eckman . | |
| 5,619,240 | 4/1997 | Pong et al. | 347/103 |
| 5,625,398 | 4/1997 | Milkovits et al. | 347/104 |
| 5,633,668 | 5/1997 | Schwiebert et al. | 347/102 |
| 5,691,756 | 11/1997 | Rise et al. | 347/102 |
| 5,697,143 | 12/1997 | Barfield | 29/611 |
| 5,708,251 | 1/1998 | Naveh | 219/121.66 |
| 5,779,870 | 7/1998 | Seip | 205/77 |
| 5,780,817 | 7/1998 | Eckman et al. . | |
| 5,806,177 | 9/1998 | Hosomi et al. | 29/846 |
| 5,822,675 * | 10/1998 | Paquet et al. | 219/544 |
| 5,829,171 | 11/1998 | Weber et al. | 36/93 |
| 5,835,679 | 11/1998 | Eckmann et al. . | |
| 5,856,650 | 1/1999 | Rise et al. | 219/216 |
| 5,940,895 | 8/1999 | Wilson et al. | 4/237 |
| 1325084 | 8/1973 | (GB) . | |
| 1498792 | 1/1978 | (GB) . | |
| 2244898 | 12/1999 | (GB) . | |
| 53-134245 | 11/1978 | (JP) . | |
| 3-129694 | 6/1991 | (JP) . | |
| 07 211438 | 11/1995 | (JP) . | |

OTHER PUBLICATIONS

European Search Report, Jul. 13, 1998.
"at HEI, Engineering is our Middle Name", Heaters Engineering, Inc., Mar. 2, 1995.
"Flexibility and cost Saving with Rope Elements", Heating Engineers, Inc. Aug. 1998.
Desloge Engineering Col, Letter to Lou Steinhauser dated Feb. 19, 1997.
Immersion Heaters Oil and Water, p. 11 (19_)v.
Special Purpose Flange Heaters, p. 58 (19_).
Lakewood Trade Literature entitled "Oil–Filled Radiator Heater" (19_).
Encon Drawing Part Nos. 02–06–480 & 02–06–481 (19_).
Encon Drawing No. 500765 (June 10, 1987).
Vulcan Electric Company Trade Literature entitled "Bushing Immersion Heaters", 1983.
Trade Literature "Euro–Burner Solid Disc Converson Burners" Energy Convertors, Inc., Dallas, PA 1991,
"Polymers, "*Guide to Selecting Engineering Materials*, a special issue of Advanced Materials& Presses, Metals Park, OH, ASM International, 1990, pp. 32–33.
Machine Design, "Basics of Design Engineering"Jun. 1991, pp. 429–432, 551, 882–884.
Machine Design, "Basics of Design Engineering", Jun. 1994, pp. 624–631.
Machine Design, May 18, 2000, 3 pages.
Carvill, Wm. T., "Prepreg Resins", Enginerred Materials Handbook, Vol. 1, Composites pp. 139–142.
Thermoplastic Polyimiode (TPI) Features, RTP Company's 4200 series compounds (4 pages).
World Headquarters, RTP Co, RTP 1300 Series Polyphenylene Sulfide Compaounds, 1 page.
World Headquarters, RTP Co, RTP 2100 Series Polyetherimide Compounds, 1 page.
World Headquarters, RTP 3400 Series Liquid Crystal Polymer Compounds, 1 page.
World Headquarters, RTP Co, RTP 4200 Series Thermoplastic Polyimide Compounds, 1 page.
A.M. Wittenberg, "Pin Shorting Contact,"Western Electric Technical Digest No. 60, Oct. 1980, p. 25.

* cited by examiner

METHOD OF MANUFACTURING A SHEATHED ELECTRICAL HEATER ASSEMBLY

BACKGROUND OF THE INVENTION

1. Field of the Invention

The present invention relates broadly to the field of electrical heaters and more particularly to a method of manufacturing electrical heaters which produces high production rates and high reliability.

2. Discussion of Background

Electrical heaters and other heating elements are widely used in many industrial heating devices as well as in household devices such as ovens. U.S. Pat. No. 3,201,738 to Mitoff, for example, discloses a heating element surrounded by a layer of magnesim-oxide, lithium-oxide insulation material and an outer protective jacket. Mitoff is directed to decreasing electrical current leakage between the resistance coils of the heating element via the use of the doped insulation material.

U.S. Pat. No. 3,211,203 to Ragland discloses an improved monolithic cathode-heater having electron tubes and a mount for the tubes. Ragland further discloses a method of making a tube having such a mount. U.S. Pat. No. 3,238,489 to Hay discloses a means for insulating and dispersing the heat of electronic units such as an electrical resistor by providing a housing that will transfer heat to the atmosphere, as well as providing an insulator between the resistor and the housing.

U.S. Pat. No. 4,633,063 to Willis discloses an improved printed circuit heating element useful for the sterile welding of thermoplastic tubes. And U.S. Pat. No. 4,501,951 to Benin et al. discloses an electric heating element for sterilely cutting and welding together thermoplastic tubes.

The method generally known in the art for manufacturing heating elements, such as those disclosed above, includes providing an insulator of some composition, generally ceramic, carefully wrapped with a wire heating element to produce a known watt density. An outer metallic jacket is then formed to conform to the inner core. Before the outer metallic jacket is mated with the insulator, a finely powdered material is usually introduced between the outer shell and the heating element. This material must be positioned to separate the metallic sheath from the wire heating element and to separate the heater elements from each other. This process is particularly difficult in the production process and, thus, reduces the production rates and the production reliability. Thus, there remains a strong need for a practical, economical, reliable method of manufacturing electrical heaters.

SUMMARY OF THE INVENTION

It is thus an object of this invention to provide an improved method of manufacturing low, medium and high wattage heaters.

It is also an object of this invention to provide an improved method of manufacturing heaters by providing injection molding of an organo-ceramic plastic mounding compound.

It is a further object of this invention to provide an improved method of manufacturing heaters by injection molding of a metal.

It is an even further object of this invention to provide a method for producing heaters with high production rates and high reliability.

These and other objects of this invention are provided by a method of manufacturing a sheathed electrical heater assembly comprising the steps of: molding a core element into a desired shape, the core element having an outer surface; heating the core element at an elevated temperature sufficient to release organic material from the core element; placing a heating element in communication with the core element; and, encapsulating the core, and heating element in an insulation protection layer, whereby the heater assembly is formed.

These and other objects are also accomplished by a sheathed electrical heater assembly comprising: a core made of an organo-ceramic material; a heating element in communication with the core; an insulation protection layer encapsulating the core and heating element to produce the heater assembly, the protection layer comprising an organo-ceramic material; and, a sheath encapsulating the heater assembly, the sheath also comprising an organo-ceramic material.

DETAILED DESCRIPTION

Figure 1:
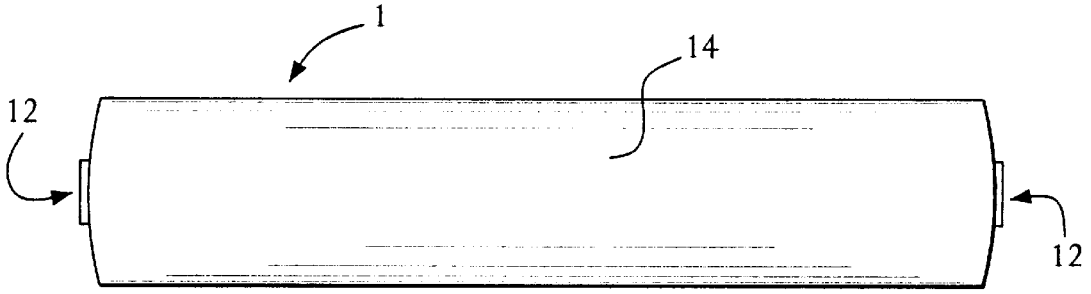
FIG. 1 is a perspective view of the heating assembly of the present invention.

The present invention discloses a new and novel method of manufacturing low, medium and high wattage heater assemblies. FIG. 1 is a perspective view of the heating assembly of the present invention. As shown in FIG. 1, heater assembly 1 has a first end 10 and a second 12 which are preferably used for placing the heating assembly 1 in communication with a power source and a ground source. Heater assembly 1 also comprises a sheath or an outer layer 14 which is normally a stainless steel tube or some other appropriate metal sheath. Outer layer 14, however, may comprise a metal such as zinc, aluminum or magnesium, or may comprise any number of metals comprising high temperature alloys such as Iconel®. For certain specific types of uses, outer layer 14 may also comprise a thermoset or a thermoplastic material. In any instance, heater assembly 1 is either placed within or molded over with an appropriate outer layer for protection of the interior assembly.

Figure 2:
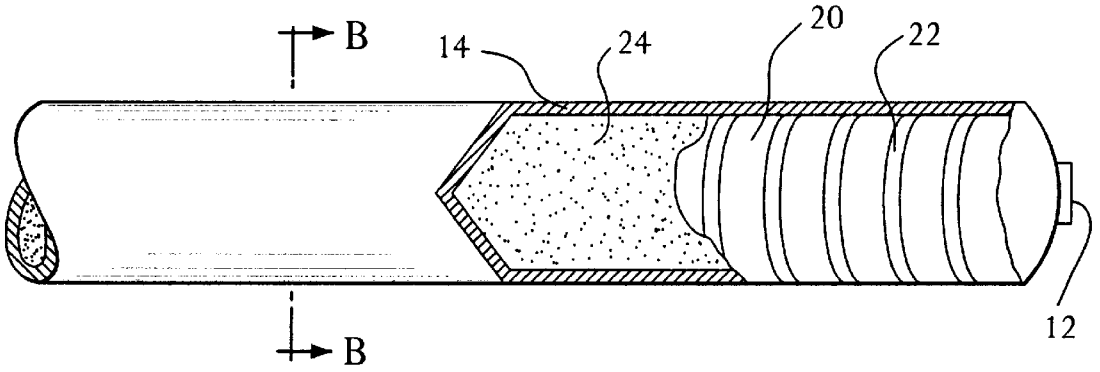
FIG. 2 is a cut-away perspective view of one embodiment of the present invention.
Figure 3:
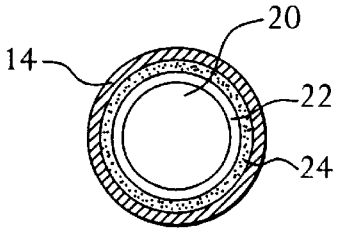
FIG. 3 is a cut-away perspective view of the invention as shown in FIG. 2 cut along line B—B.

Heater assemblies, such as heater assembly 1, may be manufactured in a variety of configurations. FIG. 2 is a cutaway perspective view of one embodiment of the heater assembly 1 of the present invention. FIG. 3 is a cut-away perspective view of the invention as shown in FIG. 2 cut along line B—B. As shown in FIG. 2 and FIG. 3, heater assembly 1 comprises a core 20. The core 20 may be a prefabricated element or it may be molded to a desired shape for a particular use. The core 20 acts as an insulator in the heater assembly 1 and may be molded of any appropriate insulating material which can withstand high temperature variants. In a preferred embodiment of the present invention, the core 20 is molded from an organo-ceramic molding compound. The organo-ceramic compound is preferred so as to increase the ability of the heater assembly 1 to withstand high temperatures and to enhance its heat conductivity. However, the core 20 may comprises materials such as phenolics, polyesters, epoxies, silicones, or materials usually comprising inorganic material. In a preferred embodiment of the present invention, the organo-ceramic core 20 is heated at an elevated temperature sufficient to pyrolize all organic material designed into the composition of the core 20. The organo-ceramic core 20 is also preferably heated in an inert atmosphere oven to ensure the core 20 is a high strength element. The core 20 should also have a high degree of thermal stability and good electrical resistance.

The core 20 may be provide in several configurations, including open-cell (not shown) and solid-core configurations as shown in FIG. 3. In either configuration, however, it is necessary to rid the core 20 or organic materials which produce gasses at elevated temperatures, the gasses being damaging to the heater assembly when it is powered and at operational temperature. When an open-cell configuration is utilized, an initial heating of the core 20 at an elevated temperature is required to expel the organic material present in the core 20. If a solid-core configuration is utilized, the core 20 will require multiple heating processes at an elevated temperature to ensure the expelling of organic material.

To avoid the need for multiple heating processes to rid the core 20 of organic material, the heater assembly 1 may be provided with an avenue to vent off gasses formed by pyrolysis either due to external heating or heating which occurs during the heater assembly 1 operation. Venting may be accomplished by, for example, providing the heater assembly 1 with vented end caps (not shown), or by utilizing an open-cell type configuration.

As further shown in FIG. 2 and FIG. 3, a wire 22 is wound in proper configuration on the core 20 such that a desired watt/density is produced. Wire 22 is preferably an electrically resistive heating conductor composed of alloys. Wire 22 may be configured in a spiral, winding or helical configuration, or wire 22 may comprise a fixed layer of metallic electrically conductive material. In any instance, wire 22 should be such that heat is produced when electrical power is applied to it via first end 10 or second end 12.

Once the wire 22 is placed in proper configuration on the core 20, the assembly is encapsulated by an insulation protection layer 24. The assembly comprising the core 20 and wire 22 is inserted into a mold as an insert for an over molding process. An organo-ceramic compound is then injected into the mold over the core 20 and wire 22 assembly to form an insulation protection layer 24 over a unitized heater unit. The insulation protection layer 24 insulates the wire 22 from shorting itself out and also protects the core 20 and wire 22 from any surrounding elements, such as outer layer 14.

To complete the heater assembly 1, the assembly comprising the core 20, wire 22 and insulation protection layer 24 may be positioned within outer layer 14, as presently done in the art. However, the present invention prefers that the assembly be placed into a mold and molded over with a desired material as previously described. The material used for the outer layer 14 should be one that is amenable to diecasting or injection molding and can range from any number of metals, organo-ceramics, or other compounds having low, medium and high temperature capabilities.

In accordance with this invention, an new and novel method of manufacturing heater assemblies using injection molding has been demonstrated. The method of this invention produces a heater with high production rates as well as high reliability. It will, therefore, be readily understood by those persons skilled in the art that the present invention is susceptible of broad utility and application. Many embodiments and adaptations of the present invention other than those described, as well as many variations, modifications and equivalent arrangements will be apparent from or reasonably suggested by the present invention and foregoing description thereof, without departing from the substance or scope of the present invention. The foregoing disclosure is not intended to be construed to limit the present invention or otherwise to exclude any such other embodiments, adaptations, variations, modifications and equivalent arrangements, the present invention being limited only by the claims appended hereto and the equivalents thereof.

What is claimed:

1. A method of manufacturing an electrical heater assembly comprising the steps of:

molding a core element into a desired shape, said core element having an outer surface, said core element comprising a compound including an organic material;

heating said core element at an elevated temperature sufficient to release organic material from said core;

placing a heating element in communication with said core element; and overmolding said core and said heating element with an organo-ceramic insulation protection layer, whereby said heater assembly is formed.

2. The method of manufacturing according to claim 1, wherein said step of molding includes providing said core with a solid shape.

3. The method of claim 2, further comprising the step of heating said heater assembly at a temperature sufficient to expel organic material from said heating assembly.

4. The method of manufacturing according to claim 1, wherein said step of molding includes providing said core with an open-cell configuration.

5. The method of manufacturing according to claim 1, wherein said step of molding includes providing said core with at least one vented end.

6. The method of manufacturing according to claim 1, wherein said step of molding includes providing said core with at least two vented ends.

7. The method of manufacturing according to claim 1, wherein said core is an organo-ceramic material.

8. The method of manufacturing according to claim 1, wherein said step of heating further comprises heating in an inert atmosphere.

9. The method of manufacturing according to claim 1, wherein said step of placing further comprises winding said heating element onto said core whereby a desired watt density is produced.

10. The method of manufacturing according to claim 1, wherein said step of placing further comprises fixing a layer of electrically conductive material over said core, whereby heat is produced when an electric current is applied to said material.

11. The method of manufacturing according to claim 1, wherein said step of overmolding includes molding over said core and said heating element with an organo-ceramic material having high electrical insulating properties and high thermal coefficient properties.

12. The method of manufacturing according to claim 1 further comprising the step of molding over said assembly with a metal material.

13. The method of manufacturing according to claim 1 further comprising the step of molding over said assembly with a thermoplastic material.

14. The method of manufacturing according to claim 1 further comprising the step of molding over said assembly with a thermoset material.

15. The method of manufacturing according to claim 1, further comprising the step of encapsulating said heater assembly with an organo-ceramic material.

16. A method of manufacturing an electrical heater assembly comprising the steps of:

providing a molded solid core, said core comprising a compound including organic material;

heating said core at a temperature sufficient to expel organic material from said core;

placing a heating element in communication with said core;

overmolding said core and said heating element with an organo-ceramic insulation protection layer such that a heating assembly is produced; and heating said heating assembly at a temperature sufficient to expel organic material from said heating assembly.

17. A method of manufacturing an electrical heater assembly comprising the steps of:

providing a molded core having an open configuration, said core comprising a compound including an organic material;

heating said core at an elevated temperature sufficient to expel organic material from said core;

placing a heating element in communication with said core; and overmolding said core and said heating element with an organo-ceramic insulation protection layer such that a heating assembly is produced.

18. An electrical heater assembly comprising:

a core, said core comprising an organo-ceramic material;

a heating element in communication with said core; and an insulation protection layer overmolding said core and said heating element to produce said heater assembly, said insulation layer comprising an organo-ceramic material.

19. The electrical heater assembly of claim 18, further comprising an organo-ceramic sheath encapsulating said heater assembly.

* * * * *